US005984980A

United States Patent [19]

Krüger et al.

[11] Patent Number: 5,984,980

[45] Date of Patent: Nov. 16, 1999

[54] PROCESS FOR CONTINUOUS DYEING IN A SINGLE OPERATION OF CELLULOSE-CONTAINING YARN WITH INDIGO

[76] Inventors: Rudolf Krüger, Südtiroler Ring 5, D-67273 Weisenheim; Franz Sütach, Hauptstrasse 159, D-67129 Rödersheim, both of Germany

[21] Appl. No.: 08/898,452

[22] Filed: Jul. 24, 1997

[30] Foreign Application Priority Data

Jul. 25, 1996 [DE] Germany ..... 196 29 985

[51] Int. Cl.[6] ..... D06P 1/22

[52] U.S. Cl. ..... 8/653; 8/650; 8/918

[58] Field of Search ..... 8/650, 651, 653, 8/918

[56] References Cited

U.S. PATENT DOCUMENTS 4,342,565 8/1982 Teague et al. ..... 8/532
5,514,187 5/1996 McFarland et al. ..... 8/401

FOREIGN PATENT DOCUMENTS 502412 3/1939 United Kingdom .

OTHER PUBLICATIONS

*Vat Dyestuffs and Vat Dyeing*, M.R. Fox, John Wiley & Sons Inc, 1948 pp. 80, 88, 1948.

*Primary Examiner*—Margaret Einsmann
*Attorney, Agent, or Firm*—Kennedy Covington Lobdell & Hickman, LLP

[57] ABSTRACT

Continuous dyeing of cellulose-containing yarn with indigo in a single operation is disclosed, in that the reduced indigo from an aqueous dye liquor containing reducing agents, alkali, and additionally a further dissolved alkali metal salt in a concentration of 200 to 350 g/l as the electrolyte, and whose pH value has been adjusted to 10.2 to 11.3, is applied to the yarn. The reduced indigo absorbed by the fibers is oxidized again to pigment while maintaining the high concentration of electrolyte, and the dye process is finished in the customary manner.

8 Claims, No Drawings

PROCESS FOR CONTINUOUS DYEING IN A SINGLE OPERATION OF CELLULOSE-CONTAINING YARN WITH INDIGO

FIELD OF THE INVENTION

The invention relates to a process for the continuous dyeing in of cellulose-containing yarn with indigo a single operation.

BACKGROUND OF THE INVENTION

Dyeing of cellulose-containing textile materials by means of vat dyes is generally known. In order to lend vat dyes, which are insoluble in water, the necessary substantivity, i.e. to fix it on the textile material, it is first necessary to change it into a substantive water-soluble leuco form by reduction (vatting) and then to develop it again into a dye pigment by oxidation.

In their leuco form, most vat dyes are distinguished by a high affinity to the fiber and therefore by high bath exhaustion of approximately 70 to 95%.

In contrast thereto, leuco-indigo is only absorbed by the fiber by 10 to 20% in a single dyeing process. Dyeing with indigo in accordance with a discontinuous extraction process (dyeing from the bath) is problematical because of this low bath exhaustion.

It is therefore customary to perform dyeing with indigo continuously "in several operations". With this method which only permits dyeing of yarn in the form of a cable or a warp sheet, but not the dyeing of piece goods or wound bodies, the vatted indigo from several (mostly five or six) dye liquors of large volume and low dyestuff concentration is applied by repeated, short (approximately 10 to 20 sec) dipping as well as squeezing and oxidizing in interspersed air passages. However, dyeing in several operations is only considered to be a stopgap measure, since it requires dyeing machinery of inefficient size, and smaller dye batches can hardly be realized. In addition, a considerable penetration of textile material is the result of the repetition of the dye process, so that extremely ring-dyed material (in particular in dark colors), which is used in the manufacture of jeans and is a prerequisite for generating the "stone-washed" effects in jeans washing, is only insufficiently obtained.

A further problem in dyeing with indigo is that the dyes obtained only have insufficient crocking fastness because of the low bath exhaustion, since dyestuff remaining in the dye bath is deposited on the textile material after oxidation and is not fixed.

OBJECT AND SUMMARY OF THE INVENTION

It is therefore an object of the present invention to remedy the mentioned shortcomings and to make an advantageous process for the continuous dyeing of cellulose-containing yarn with indigo, by means of which it is also possible to dye with dark colors with a satisfactory crocking fastness and to produce ring-dyed yarn.

Accordingly, a process for the continuous dyeing of cellulose-containing yarn with indigo in one operation was developed, in which the reduced indigo from an aqueous dye liquor containing reducing agents, alkali, and additionally a further dissolved alkali metal salt in a concentration of 200 to 350 g/l as the electrolyte, and whose pH value has been adjusted to 10.2 to 11.3, is applied to the yarn, and the reduced indigo absorbed by the fibers is oxidized again to pigment while maintaining the high concentration of electrolyte, and the dye process is finished in the customary manner.

One feature of the process of the present invention is that dyeing or the absorption of the reduced dyestuff on the fibers is performed in the presence of extremely high electrolyte concentrations.

In this context it is important that the high electrolyte concentration be maintained until reoxidation of the reduced dyestuff to pigment. This can be done in a simple manner by taking the moist yarn obtained after the removal of the dye liquor, which still contains sufficient amounts of electrolyte, to the oxidation process without previously rinsing it.

Suitable electrolytes include essentially neutral alkali metal salts that are sufficiently soluble in water in order to adjust the desired concentration of dissolved electrolyte. This concentration is generally approximately 200 to 350, preferably 250 to 330, and most preferably approximately 300 g/l of liquor.

Neutral sodium salts are particularly suited as electrolytes, including sodium nitrate, and, preferably sodium chloride. It is also possible to employ mixtures of less soluble salts, such as sodium sulfate or sodium phosphate. Also suitable are sodium acetate and sodium formiate.

The pH value of the liquor of the present invention is adjusted to a pH value which, in comparison with customary vat dyeing (pH value 13 to 13.5), is reduced to generally 10.2 to 11.3, preferably 10.8 to 11.1. This can be advantageously achieved if, for example, sodium carbonate is used as the alkali in place of the otherwise customary sodium hydroxides.

By means of the measures in accordance with the invention it is possible to increase the substantivity of the indigo to such a degree that more than 95% of the vatted indigo is absorbed by the textile fiber in single dipping (in one operation).

In connection with the dye process in accordance with the present invention, it is practical to proceed in such a way that the indigo is placed in pre-reduced form into the aqueous liquor, which contains reducing agent, alkali and additional electrolyte, or it is added in portions or continuously to this liquor during the dipping of the yarn. For example, the so-called "stock vats," i.e., the leuco-indigo solutions produced in an upstream container by reduction with sodium dithionite in the presence of sodium hydroxide at increased temperatures, and especially alkaline-aqueous leuco-indigo solutions, such as are obtained by catalytic hydration of indigo, are suitable for this. These solutions generally contain 10 to 35 weight % of indigo and 2 to 10 weight % of alkali.

Since, when using the pre-reduced indigo, it might only be necessary to again reduce indigo which was re-oxidized by an unintentional addition of air, the dye liquor customarily contains only 0.5 to 1.5 g of reducing agent. Sodium dithionite is preferably employed as the reducing agent.

In order to increase the liquor retention ability of the yarn, it is recommended to add a lubricating and thickening agent to the dye liquor. Polymers with polar groups on an acrylate basis are suitable for this.

It is of particular advantage that, in accordance with the present invention, it is possible to dye the yarn (as cable or as a warp sheet) at short liquor ratios (as a rule$\leqq$1:20).

It is possible to operate with a relatively long dipping time (approximately 1 min) and therefore with almost completely exhausted dye liquors, or also with relatively short dipping times (approximately 1 to 5 sec.) and a leuco-indigo concentration which is maintained constant, as well as a downstream fixating zone in an oxygen-free atmosphere (approximately 1 min).

After restocking with leuco-indigo and replenishing the reducing agent, alkali and electrolyte, as well as the lubricating and thickening agents, if required, the exhausted dye liquor can again be used for dyeing.

In a particularly preferred embodiment of the process in accordance with the present invention, the yarn is pre-impregnated with a wetting liquor, which already contains alkali and electrolyte, prior to applying the leuco-indigo. To this end, the wetting agent is preferably heated to 60 to 95° C. Following the treatment, the yarn is squeezed in a customary way and cooled in the air passage.

It is possible to achieve particularly extreme ring dyeing by proceeding in this manner. Furthermore, a pre-treatment which would increase the wetability of the yarn can be omitted.

The final oxidation of the absorbed leuco-indigo into pigment is performed without prior rinsing of the yarn and advantageously takes place in air.

The completion of the dyeing process can take place in the usual way by rinsing and neutralizing. If necessary, washing or soaping processes can be performed afterwards.

It is possible with the aid of the process in accordance with the invention to dye cellulose-containing yarn in the form of a cable or as a warp sheet continuously with indigo in an advantageous and dependable manner and with high quality. The colorations obtained are distinguished by their high crocking fastness and evenness, even dark (in general approximately 2 to 3%) colorations can be achieved without problems. The process in accordance with the present invention is particularly distinguished in that extremely ring-dyed warp yarn, which permits a quick wash-down in connection with the jeans wash, can be easily obtained. Furthermore, it is possible to dye in only one operation and at a short liquor ratio, which makes the replacement of dyeing lines by more compact dye machines possible.

DETAILED DESCRIPTION

Example 1

Continuous Warp Yarn Dyeing as a Warp Sheet (Slasher)

A cotton warp yarn of Nm 12 (12 km/kg of yarn) with 4080 individual threads in the warp was used. The running speed of the cotton warp was 30 m/min, which corresponded to a yarn throughput of 10.2 kg/min. The batch length was approximately 30000 m.

Prior to applying the reduced indigo, the dry warp sheet was impregnated with a hot (approximately 92° C.) pre-wetting liquor, which contained 280 g/l of sodium chloride and 20 g/l of anhydrous sodium carbonate, was then squeezed to about 60% liquor content, and cooled in the following air passage. In the process, the pre-wetting liquor was maintained at a constant fill level by means of an automatic replenishment regulation from a storage reservoir.

The subsequent application of the viscous dye liquor, which contained 280 g/l of sodium chloride 20 g/l of anhydrous sodium carbonate 30 g/l of an alkaline-aqueous leuco-indigo solution of 20 weight % (4.8 weight % sodium hydroxide, a commercial product of BASF)

1 g/l of sodium dithionite (88%), and 30 g/l of a lubricating and thickening agent, took place in a padding machine with very soft squeezing rollers and an economy volume vat containing approximately 80 l of dye liquor at a dipping time of approximately 2 sec. and a liquor content of approximately 250%, i.e. a liquor addition of 190%.

The padding machine outlet was constructed in such a way that immediately after squeezing and without contact with the air the warp sheet directly entered into an oxygen-free dwelling chamber with fixed material guidance and remained there for approximately 60 sec. at room temperature for dye fixing.

After leaving the dwelling chamber, the warp sheet was squeezed in a second padding machine under high pressure to a liquor content of approximately 80%. The squeezing liquor which was low in dye was caught and, following an adjustment to the desired viscosity and replenishment of leuco-indigo, alkali, electrolyte, and sodium dithionite, was returned to the dye vat.

The fixed leuco-indigo was oxidized into pigment in the subsequent air passage (approximately 60 sec.).

Subsequently, approximately 85% of the exhausted liquor still contained in the warp sheet was washed out with little water. The washing liquor was caught for renewed use as the pre- wetting liquor and was transferred into a storage reservoir.

Following washing, the warp sheet was pre-dried on cylinder dryers before the sizing was applied.

The cotton warp yarn contained 1.1% indigo in an extreme ring coloration.

Example 2

Continuous Warp Yarn Dyeing in Cable Form (Rope)

A cotton warp yarn of Nm 12 was used, which was available for dyeing in the form of 12 separate cables (ropes) with 340 individual threads. The running speed of the cables was 25 m/min, which corresponded to a yarn throughput of 8.5 kg/min. The batch length was approximately 30000 m.

Prior to the application of the reduced indigo, the dry cables were impregnated with a hot pre-wetting liquor, analogously to Example 1, were squeezed to 60% liquor content, and cooled in the air passage.

The subsequent application of the viscous dye liquor, which was composed the same as in Example 1, took place in a padding machine with very soft squeezing rollers and a dye trough provided with a plurality of reversing rollers in a dipping passage with a liquor application of approximately 250%, i.e. a liquor addition of 190%, while reusing the squeezing liquor.

The padding machine outlet was constructed in such a way that the cable remained in a following slide under exclusion of the oxygen in the air for approximately 60 sec. for fixing the dye.

After leaving the dwelling slide, further processing took place analogously to Example 1: the cables were squeezed to 80% liquor content, the fixed leuco-indigo was oxidized to pigment, and dyeing was completed by washing (reusing the washing liquor) and drying.

The cotton warp yarn contained 1.1% indigo in an extreme ring coloration.

Example 3

Continuous Warp Yarn Dyeing in the Dyeing Tube (Pipe Dyeing)

A cotton warp yarn of Nm 12 was used, which was available for dyeing in the form of 12 separate cables (ropes) with 340 individual threads. The running speed of the cables was 25 m/min, which corresponded to a yarn throughput of 8.5 kg/min. The batch length was approximately 30000 m.

Prior to the application of the reduced indigo, the dry cables were impregnated with a hot pre-wetting liquor, analogously to Example 1, were squeezed to 60% liquor content, and cooled in the air passage.

For the application of the dye liquor, which contained 280 g/l of sodium chloride 20 g/l of anhydrous sodium carbonate 10 g/l of an alkaline-aqueous leuco-indigo solution of 20 weight % (4.8 weight % sodium hydroxide, a commercial product of BASF), and 1 g/l of sodium dithionite (88%), the individual cables were inserted from the air passage into respectively individual separate dyeing tubes, i.e., the dyeing portion of the installation consisted of 12 dyeing tubes, each of 25 m dipping length. The dyeing tubes were provided with fresh dyeing liquor by a circulation system in such a way that identical flow conditions with equal dyestuff concentrations were provided in the individual tubes. The cables and the liquor moved in the same direction, but the cables at twice the speed. The relation of throughput yarn and liquor was 1:8.

After dwelling in the dyeing tubes, the cables were squeezed in a padding machine under high pressure to a liquor content of approximately 80%, i.e., they were freed to 90% of the dyeing liquor carried along. The squeezing liquor, which was low in dyestuff, was caught and returned to the circulation system after replenishing the leuco-indigo, alkali, electrolyte, and sodium dithionite.

The fixed leuco-indigo was subsequently oxidized into pigment, analogously with Example 1, and dyeing was completed as in Example 1 by washing (with the washing liquor being reused) and drying.

The cotton warp yarn contained 1.6% indigo in a good ring coloration.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A process for continuous dyeing of cellulose-containing yarn with indigo in a single operation, comprising the steps of applying reduced indigo from an aqueous dye liquor containing sodium dithionate, alkali, and a neutral alkali metal salt in a concentration of 200 to 350 g/l as an electrolyte, and whose pH value has been adjusted to 10.2 to 11.3, to the yarn, and reoxidizing the reduced indigo absorbed by the fibers to pigment while maintaining the high concentration of electrolyte.

2. The process in accordance with claim 1, wherein the electrolyte is sodium chloride.

3. The process in accordance with claim 1, wherein the alkali is sodium carbonate or a mixture of sodium hydroxide and sodium hydrogencarbonate.

4. The process in accordance with claim 1, wherein the indigo is placed in its pre-reduced form into the aqueous dye liquor containing the sodium dithionate, alkali and the additional dissolved alkali metal salt.

5. The process in accordance with claim 1, further comprising the step of adding pre-reduced indigo to the dyeing liquor.

6. The process in accordance with claim 1, wherein a liquor ratio of no more than about 1:20 is employed.

7. The process in accordance with claim 1, further comprising the step of impregnating the dry yarn with an aqueous liquor prior to dyeing, said liquor containing alkali and a dissolved alkali metal salt at a concentration between 200 to 350 g/l as an electrolyte, and whose pH value is adjusted to 10.2 to 11.3.

8. The process in accordance with claim 1, wherein the yarn is dyed as a cable or warp sheet.

* * * * *